US007281638B2

(12) United States Patent
Hierzer et al.

(10) Patent No.: US 7,281,638 B2
(45) Date of Patent: Oct. 16, 2007

(54) SNAP-HINGE CLOSURE WITH TAMPER-EVIDENT LID AND METHOD OF MAKING

(75) Inventors: Valentin Hierzer, Arlington Heights, IL (US); Rick Gaiser, Spring Grove, IL (US); Gordon Beth, Schaumburg, IL (US)

(73) Assignee: Obrist Closures Switzerland GmbH (CH)

( * ) Notice: Subject to any disclaimer, the term of this patent is extended or adjusted under 35 U.S.C. 154(b) by 0 days.

(21) Appl. No.: 09/911,052

(22) Filed: Jul. 24, 2001

(65) Prior Publication Data

US 2004/0200836 A1 Oct. 14, 2004

(51) Int. Cl.

| | |
|---|---|
| ***B65D 51/20*** | (2006.01) |
| ***B65D 43/18*** | (2006.01) |
| ***B65D 43/14*** | (2006.01) |
| ***B65D 39/08*** | (2006.01) |
| ***B65D 41/34*** | (2006.01) |
| ***B67D 5/00*** | (2006.01) |
| ***B67D 47/10*** | (2006.01) |

(52) U.S. Cl. ..... 220/257.1; 220/835; 220/839; 220/259.1; 215/235; 215/237; 215/253; 222/153.06; 222/541.5; 222/541.6

(58) Field of Classification Search ..... 222/153.06, 222/541.5, 541.6, 541.9, 556, 562; 215/252, 215/253, 255, 237, 235, 387, 305; 220/257.1, 220/257.2, 259.1, 259.3, 264, 266, 268, 835, 220/836–839, 703, 705, 711, 717

See application file for complete search history.

(56) References Cited

U.S. PATENT DOCUMENTS

| | | | | |
|---|---|---|---|---|
| 3,255,928 | A * | 6/1966 | Foster | 222/153.07 |
| 3,651,992 | A * | 3/1972 | Hazard | 222/153.06 |
| 4,592,480 | A * | 6/1986 | Hart et al. | 220/270 |
| 4,941,580 | A * | 7/1990 | Julian | 215/235 |
| 4,941,592 | A * | 7/1990 | Kitterman | 222/23 |
| 5,085,333 | A | 2/1992 | Dutt et al. | |
| 5,141,138 | A | 8/1992 | Odet et al. | |
| 5,147,054 | A | 9/1992 | Pehr | |
| 5,201,440 | A * | 4/1993 | Gross | 222/153.07 |
| 5,330,083 | A | 7/1994 | Bartimes et al. | |
| 5,386,918 | A * | 2/1995 | Neveras et al. | 215/235 |
| 5,392,938 | A | 2/1995 | Dubach | |

(Continued)

FOREIGN PATENT DOCUMENTS

| | | |
|---|---|---|
| EP | 0345403 | 12/1989 |

(Continued)

*Primary Examiner*—Robin A. Hylton
(74) *Attorney, Agent, or Firm*—Nixon Peabody LLP

(57) ABSTRACT

A tamper evident hinge type closure includes, as is conventional in such closures, a body portion, a lid portion and a hinge portion. Advantageously, at least one tamper evident band is provided so as to mechanically secure the lid portion to the body portion at a position that is distal from the hinge. The tamper evident band, which is designed to break upon initial opening of the closure by a consumer, is preferably integral with both the body portion and the lid portion, so as to ensure more reliably than was possible with interlocking mechanical tamper evident structures that the closure may not be opened without defeating the tamper evident band. A process for making the improved closures is also disclosed.

12 Claims, 4 Drawing Sheets

U.S. PATENT DOCUMENTS

| | | | | |
|---|---|---|---|---|
| 5,489,035 | A | 2/1996 | Fuchs | |
| 5,632,417 | A | 5/1997 | Robbins, III et al. | |
| 5,662,245 | A * | 9/1997 | Grant | 222/153.07 |
| 5,799,840 | A * | 9/1998 | Mogard | 222/541.5 |
| 5,913,435 | A | 6/1999 | Fuchs | |
| 6,116,441 | A * | 9/2000 | Decelles et al. | 215/237 |
| 6,152,320 | A * | 11/2000 | Hierzer et al. | 220/838 |
| 6,216,905 | B1 | 4/2001 | Mogard et al. | |
| 6,234,334 | B1 * | 5/2001 | Suarez | 215/237 |
| 6,269,986 | B1 * | 8/2001 | Gross | 222/541.5 |
| 6,347,716 | B1 * | 2/2002 | Nofer et al. | 215/235 |
| 6,405,885 | B1 * | 6/2002 | Elliott | 215/237 |
| 6,631,820 | B2 * | 10/2003 | Harrold et al. | 215/237 |
| 6,644,487 | B2 * | 11/2003 | Smith et al. | 215/235 |
| 2002/0079282 | A1 * | 6/2002 | Harrold et al. | 215/237 |

FOREIGN PATENT DOCUMENTS

| | | | |
|---|---|---|---|
| EP | 0486408 | | 5/1992 |
| EP | 0507706 | | 10/1992 |
| EP | 0541466 | | 5/1993 |
| WO | WO 94/02373 | * | 2/1994 |
| WO | WO 97/02190 | | 1/1997 |
| WO | WO 97/33802 | | 9/1997 |
| WO | WO 98/57864 | | 12/1998 |
| WO | WO 00/76875 | | 12/2000 |

* cited by examiner

SNAP-HINGE CLOSURE WITH TAMPER-EVIDENT LID AND METHOD OF MAKING

BACKGROUND OF THE INVENTION

1. Field of the Invention

This invention relates broadly to the field of packaging and more specifically to a tamper evident container closure for packaging products such as beverages.

2. Description of the Related Technology

Plastic closures for containers such as beverage bottles are in widespread use throughout the world. In recent years, circumstances in many countries has resulted in an increase in demand for tamper evident features on such closures.

As is described in U.S. Pat. No. 5,392,938, the use of tamper evident security bands in plastic screw closures for bottles having a screw cap has been common for some time, but the use of such security bands on snap hinge closures has been much less common. In all of the snap hinge closures of which the inventors are aware, the body, the lid and the hinge of the closure is molded together in one piece and mechanical interlocking structure is formed in the body and/or the lid for causing the lid to become mechanically affixed to the body when the lid is pressed onto the body after manufacturing. This mechanical connection is designed to be defeated in a tamper evident manner, such as by rupturing of frangible bars or webs within the connection when the closure is first opened by a consumer.

Unfortunately, in too many circumstances the mechanical connections described above are able to be defeated without rupturing the tamper evident bars or webs by a person who is determined to do so. This, of course, is unacceptable for many different reasons. A need exists for an improved snap hinge tamper evident closure and a method for making such a closure that is impossible to open without defeating the tamper evident structure of the closure.

SUMMARY OF THE INVENTION

Accordingly, it is an object of the invention to provide an improved snap hinge tamper evident closure and a method for making such a closure that is impossible to open without defeating the tamper evident structure of the closure.

In order to attain the above and other objects of the invention, a snap hinge tamper evident closure that is constructed according to a first aspect of the invention includes a body portion that is constructed and arranged to be secured to a container; a lid portion; a hinge portion that is attached to the body portion and the lid portion so as to permit the lid portion to be opened from and closed onto the body portion after the closure is first opened; and at least one tamper evident band mechanically securing the lid portion to the body portion at a position that is distal from the hinge portion, the tamper evident band being integral at a first location with the body portion and further being integral at a second location with the lid portion, whereby the closure may not be opened without defeating the tamper evident band.

According to a second aspect of the invention, a method of making a tamper evident closure includes steps of (a) forming a closure blank that includes a body portion, a hinge portion and a lid portion; and (b) securing the body portion to the lid portion at a location that is distal from the hinge portion with at least one frangible tamper evident connection that is integral with both the body portion and the lid portion, whereby a tamper evident closure is formed that may not be opened without defeating the frangible tamper evident connection.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
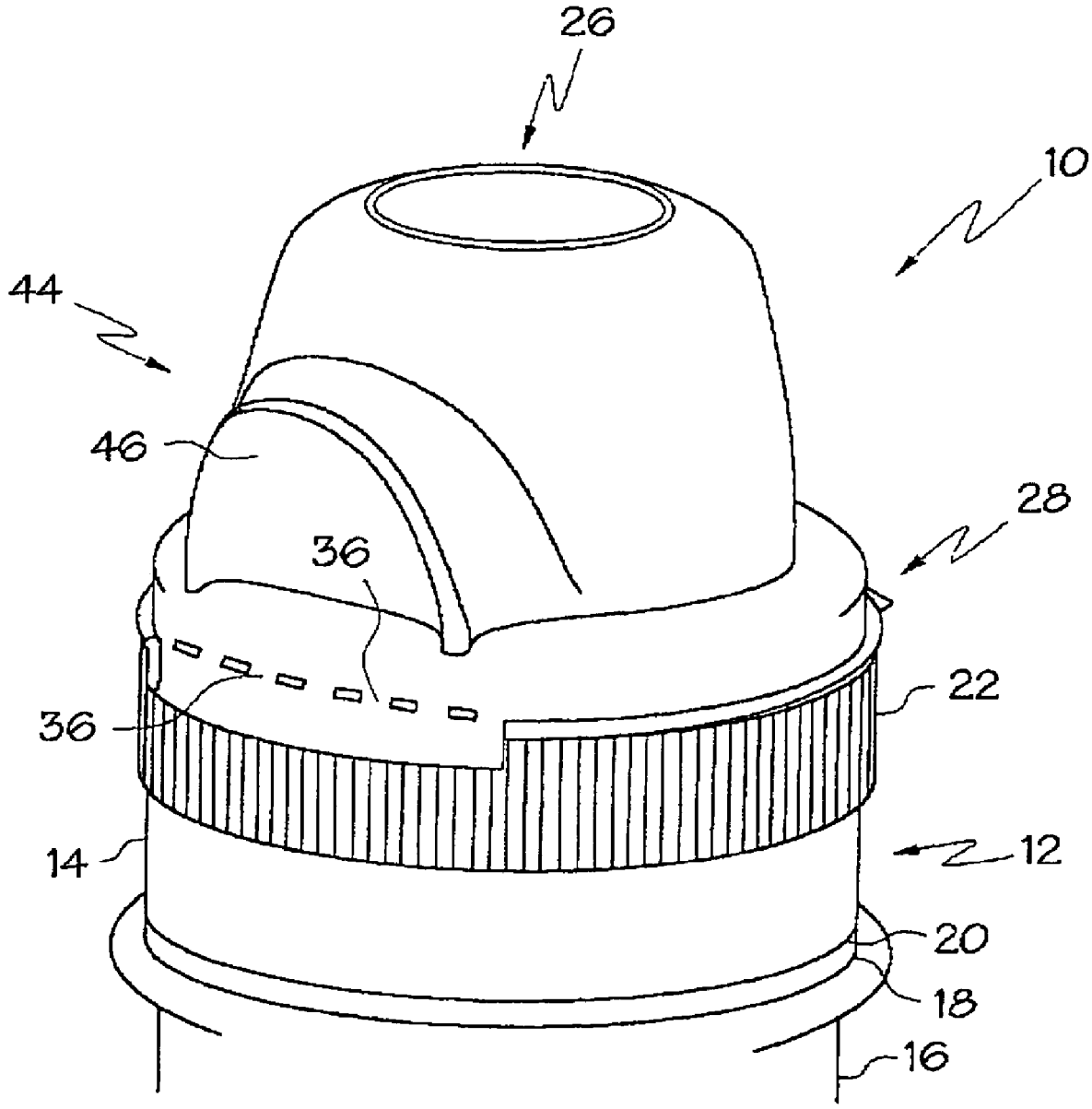
FIG. 1 is a perspective view of a hinged closure that is constructed according to a preferred embodiment of the invention.

Referring now to the drawings, wherein like reference numerals designate corresponding structure throughout the views, and referring in particular to FIG. 1, a tamper evident hinge type closure 10 that is constructed according to the preferred embodiment of the invention includes a body portion 12 that is constructed and arranged to be secured to a container, a lid portion 26 and a hinge portion 28 that is attached to the body portion 12 and the lid portion 26 so as to permit the lid portion 26 to be opened from and closed on to the body portion 12 after the closure 10 is first opened by a consumer. The closure 10 is preferably fabricated in one piece from a plastic material such as polypropylene or polyethylene.

Figure 2:
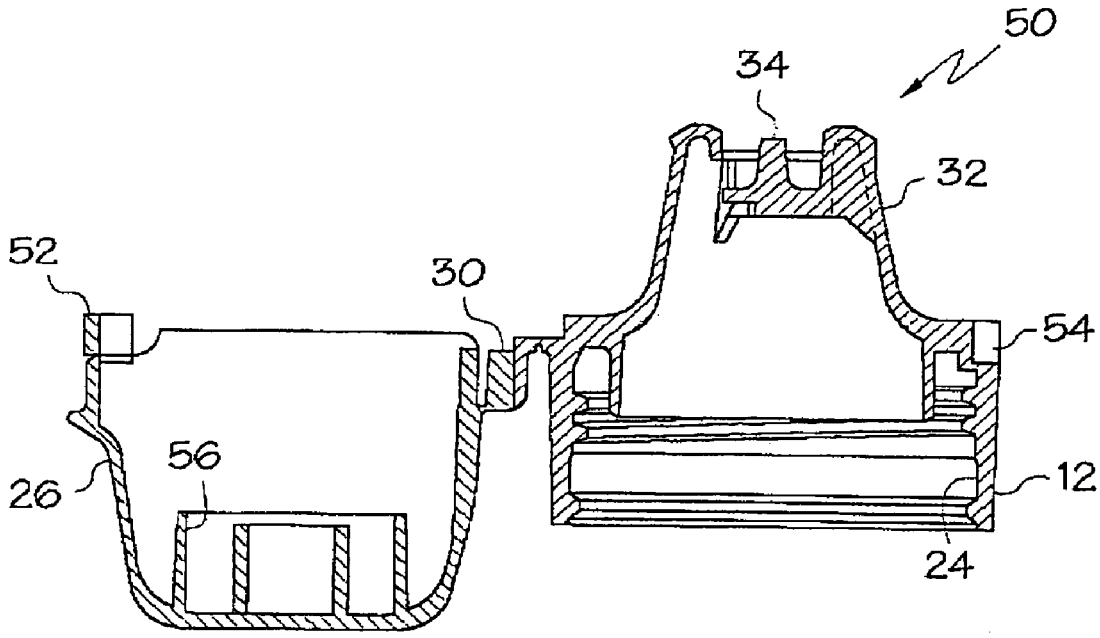
FIG. 2 is a cross-sectional view depicting a closure blank that is used in performing a method for making a hinged closure according to the preferred embodiment of the invention.
Figure 3:
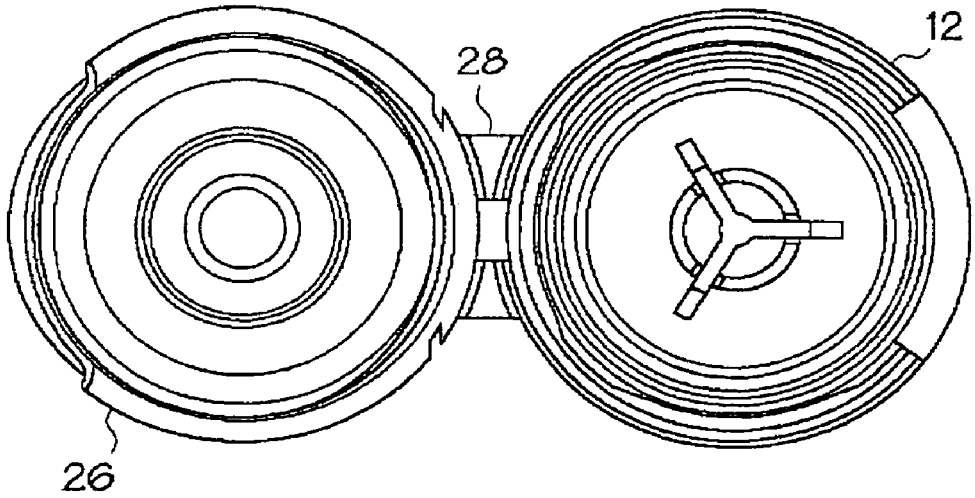
FIG. 3 is a top plan view of the closure blank that is depicted in FIG. 2.
Figure 4:
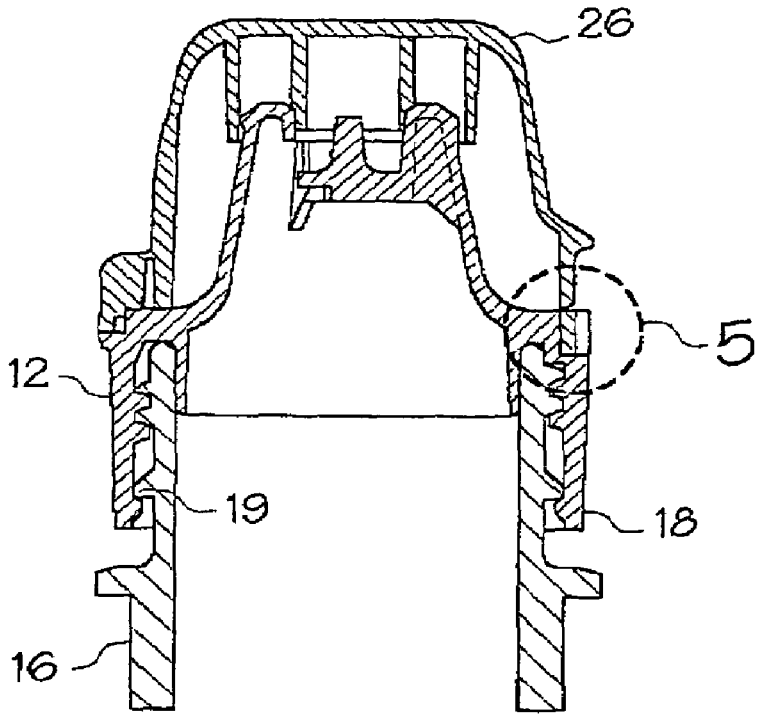
FIG. 4 is a cross-sectional view depicting the closure blank shown in FIG. 2 after it has been mounted on a container.

As may be seen in FIG. 1, body portion 12 includes a downwardly depending cylindrical skirt 14 that is provided with internal threading 24, best shown in FIG. 2, so as to be screwable onto the corresponding external threading of the finish portion of a container 16, as is shown in FIG. 4. A tamper evident band 18 is molded into the lower end of the downwardly depending cylindrical skirt 14 and is defined with respect to the rest of the cylindrical skirt 14 by a conventional frangible circumferential slit 20. As is best shown in FIG. 4, tamper evident band 18 includes an annular projection that protrudes radially inwardly so as to slip over a sloped upper surface of a circumferential rib 19 that is defined on the finish portion of the container 16 during installation of the closure 10 onto the container 16. After installation, the annular projection will bear against the unsloped lower surface of the circumferential rib 19, which will prevent the tamper evident band 18 from passing upwardly over the circumferential rib 19. If they consumer attempts to unscrew the closure 10 from the container 16, the tamper evident band 18 will become separated from the rest of the skirt 14 at the frangible circumferential slit 20.

As is further shown in FIG. 1, the body portion 12 is provided with textured fluting 22 in order to aid gripping of the closure 10 if it is desired to unscrew the closure 10 from the container 16. Body portion 12 further defines a pouring spout 32 that in the preferred embodiment is provided with aeration structure 34 (also known as anti-glug structure) for providing a smooth, uninterrupted flow of liquid during dispensation. Hinge portion 28 is preferably constructed as an articulated hinge 30 that is constructed and arranged to retain the lid portion 26 in a retracted position with respect to the body portion 12 after opening so as to minimize interference with a consumer who is drinking from the container 16.

According to one particularly advantageous feature of the invention, closure 10 is constructed so that after assembly and prior to opening by a consumer the lid portion 26 is secured to the body portion 12 at a location that is distal from the hinge portion 28 with at least one frangible tamper evident connection that is integral, and preferably unitary, with both the body portion 12 and the lid portion 26. This integral connection is superior to mechanical interlocking tamper evident arrangements and that it cannot be defeated without destroying the connection itself. In a preferred embodiment of the invention, this frangible tamper evident connection is embodied as a plurality of tamper evident bands 36 that are molded or welded so as to be unitary with lid portion 26 and that are further made integral, preferably by fusing, with the body portion 12. As may be seen in FIG. 1, gripping structure 44 is defined on the lid portion 26 for facilitating gripping, and specifically lifting, of the lid portion 26 with respect to the body portion 12 in a direction that is necessary to defeat the tamper evident bands 36 during initial opening of the closure 10 by the consumer. In the preferred embodiment, gripping structure 44 is embodied as a thumb engaging area 46 that is sized and shaped to be pressed and pulled upwardly by a consumer's thumb. As may be seen in FIG. 1, the thumb engaging area 46 is positioned substantially above the tamper evident bands 36 so as to place tensile stress on the tamper evident bands 36 when lifted.

Figure 5:
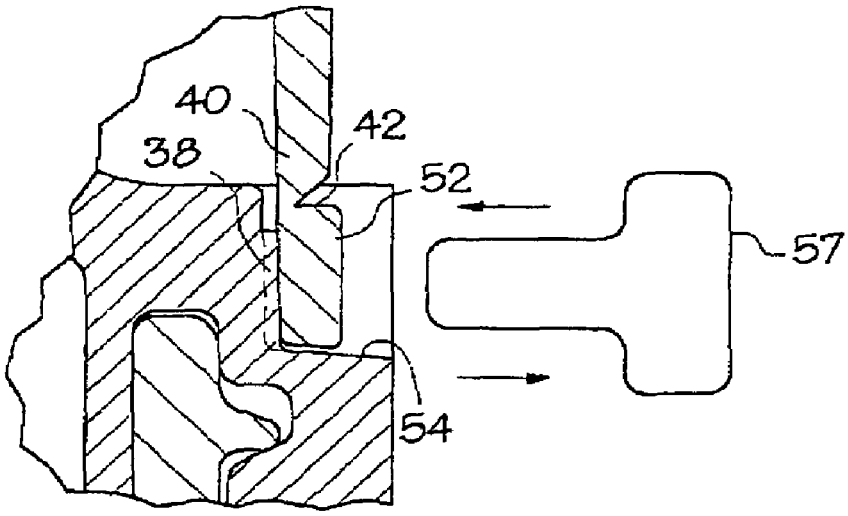
FIG. 5 is a fragmentary cross-sectional view providing an enlarged view of a portion of the assembly that is depicted in FIG. 4.

As is best shown in FIG. 5, which is a depiction of the step of fusing one of the tamper evident bands 36 to the body portion 12 during assembly, each of the tamper evident bands 36 is unitary after such fusing to a deck area 54 of the body portion 12 at a first location 38, and is unitary with the lid portion 26 at a second location 40 which, in the preferred embodiment, is located near an area of 42 a predetermined frangibility, form as a transverse groove that is defined in the tamper evident band 36.

Another particularly advantageous feature of the invention involves the methods for making the improved closure of the invention. In the preferred embodiment, this is performed by first molding a closure blank 50 that includes, as is shown in FIG. 2, the body portion 12, the hinge portion 28 and the lid portion 26, as well as the additional preferred structure of the closure 10 described above. The closure blank 50 includes, as may be seen in FIG. 2, a plurality of band blank projections 52 that extend from the lower lip of the sidewall of the lid portion 26. The closure blank 50 is initially molded so as to be in the open position that is depicted in FIG. 2. During assembly, and as is shown in FIGS. 4 and 5, the closure blank is snapped into the closed position, so that a spout engaging portion 56 that is molded into the interior of the lid portion 26 snapped into the spout 32. This causes the band blank projections 52 to position themselves immediately adjacent to a deck area 54 of the body portion 12. At this time, energy is applied to fuse each of the band blank projections 52 to the body portion 12 at the first location 38. In the preferred embodiment, this is performed by applying sonic energy in the vicinity of the first location 38 by means of a sonic horn 57. The step completes manufacture of the closure 10.

Figure 6:
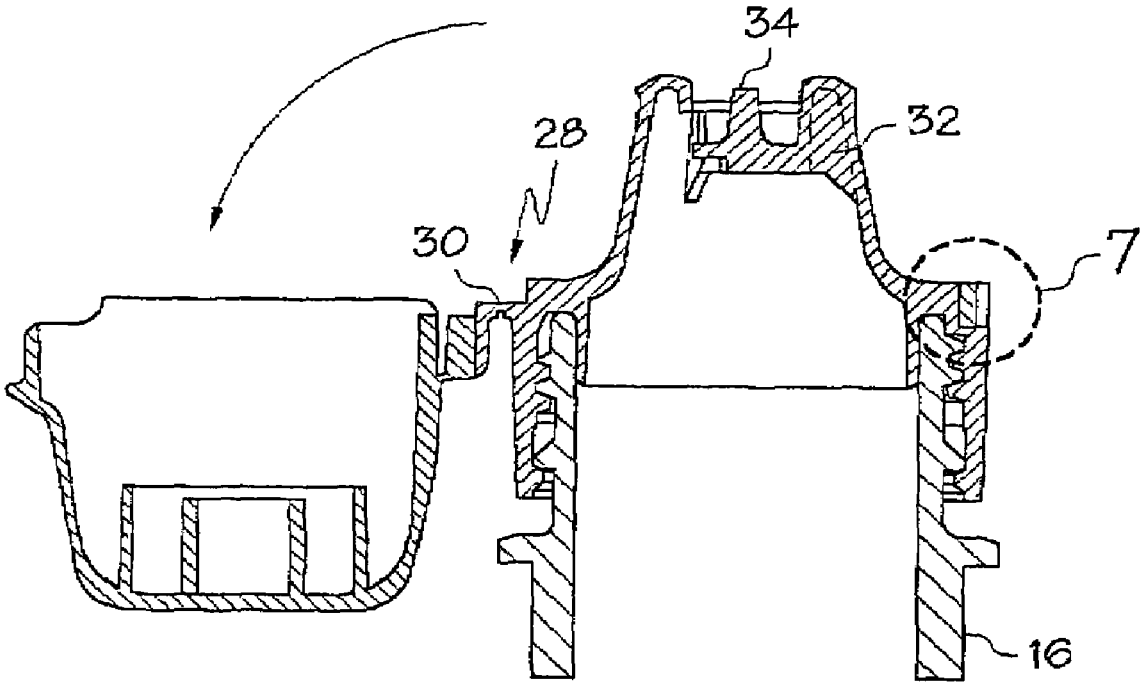
FIG. 6 is a cross-sectional view depicting a closure according to the preferred embodiment of the invention after it has been opened by a consumer.
Figure 7:
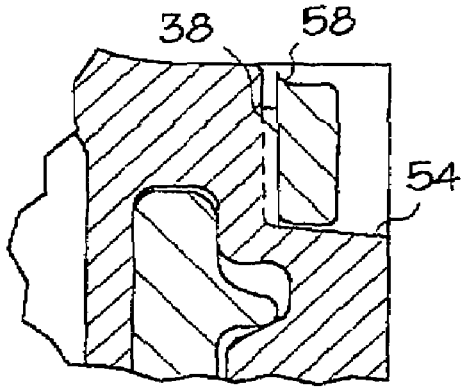
FIG. 7 is a fragmentary cross-sectional view providing an enlarged view of a portion of the opened container assembly that is depicted in FIG. 6.

FIGS. 6 and 7 depict initial opening of the closure by a consumer, which is preferably performed by the placement of the consumers thumb on the thumb engaging area 46 of the lid portion 26 and subsequently lifting the lid portion 26 away from the body portion 16 so as to fracture the tamper evident bands 36 at an area of separation 58 that corresponds to the area of predetermined frangibility 42.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A tamper evident snap-hinged closure, comprising:

a body portion that is constructed and arranged to be secured to a container;

a lid portion;

a hinge portion that is attached to said body portion and said lid portion so as to permit said lid portion to be opened from and closed on to said body portion after said closure is first opened;

at least one tamper evident band connecting said body portion and said lid portion, said at least one tamper evident band mechanically securing said lid portion to said body portion at a position that is diametrically opposed from and distal from said hinge portion, said at least one tamper evident band being integral at a first location with said body portion and further being unitary at a second location with said lid portion, whereby said closure may not be opened without defeating said at least one tamper evident band, and wherein at least a portion of said at least one tamper evident band is designed to remain attached to at least one of said body portion and said lid portion upon opening of said closure; and gripping structure defined on at least one of said body poriton and said lid portion for facilitating gripping by a consumer in a direction that is necessary to defeat said at least one tamper evident band during opening; wherein said gripping structure comprises a gripping projection that is defined on said lid portion and positioned substantially above said at least one tamper evident band so as to place stress on said tamper evident band when lifted.

2. A tamper evident snap-hinged closure according to claim 1, wherein said body portion is constructed and arranged to be screwed on to a container, and wherein said body portion further comprises at least one tamper evident band that is constructed and arranged to become seperated from said body portion when said body portion is unscrewed from the comtainer.

3. A tamper evident snap-hinged closure according to claim 1, wherein said hinge portion comprises an articulated hinge that is constructed and arranged to retain said lid portion in a retracted position with respect to said body portion after opening so as to minimize interference with a consumer who is drinking from the container.

4. A tamper evident snap-hinged closure according to claim 1, wherein said body portion further comprises a drinking spout that is constructed and arranged to facilitate from the container.

5. A tamper evident snap-hinged closure according to claim 1, wherein said gripping projection is shaped and sized to be engaged by a single digit of a consumer.

6. A tamper evident snap-hinged closure according to claim 5, wherein said gripping projection is shaped and sixed to be engaged by a thumb of a consumer.

7. A tamper evident snap-hinged closure according to claim 1, wherein said at least one tamper evident band comprises a plurality of tamper evident band projections.

8. A tamper evident snap-hinged closure according to claim 1, wherein said at least one tamper evident band comprises a plurality of tamper evident band projections.

9. A tamper evident snap-hinged closure according to claim 8, wherein said at least one tamper evident band is sonically fused to said body portion at said first location.

10. A tamper evident snap-hinged closure according to claim 1, wherein said at least one tamper evidnet band comprises an area of predetermined frangiblility at which failure is designed to occur during opening.

11. A tamper evident snap-hinged closure, comprising:

a body portion that is constructed and arranged to be secured to a container, said body portion comprising a drinking spout that is constructed and arranged to facilitate drinking from the container;

a lid portion a hinge portion that is unitary with said body portion and said lid portion so as to permit said lid portion to be opened from and closed on to said body portion in order to selectively open and close said drinking spout after said closure is first opened;

at least one tamper evident band connecting said body portion and said lid portion, said at least one tamper evident band mechnically securing said lid portion to said body portion at a position that is diametrically opposed from and distal from said hinge portion, said at least tamper evident band being unitary at a first location with said lid portion, and further being integral at a second location with said body portion, whereby said closure may not be open without defeating said at least one tamper evident band; and gripping structure defined on at least one of said body portion and said lid portion for facilitating gripping by a consumer in a direction that is neccesary to defeat said at least one tamper evident band during opening; wherein said gripping structure comprises a gripping projection that is defined on said lid portion and positioned substantially above said at least one tamper evident band so as to place stress on said at least one tamper evident band when lifted.

12. A tamper evident snap-hinged closure, comprising:

a body portion that is constructed and arranged to be secured to a container;

a lid portion;

a hinge portion that is attached to said body portion and said lid portion so as to permit said lid portion to be opened from and closed on to said body poriton after said closure is first opened;

at least one tamper evident band connecting said body poriton and said lid portion, said at least one tamper evident band mechanically securing said lid portion to said body portion at a position that is diametriccally opposed from and distal from said hinge portion, said at least one tamper evident band being integral at a frist location with said body portion and further being unitary at a second location with said lid portion, whereby said closure at least a portion of said at least one tamper evident band is designed to remain attached to at least one of said body portion and said lid portion upon opening of said closure; and gripping structure that is defined on said lid portion for facilitating gripping by a consumer in a direction that is necessary to defeat said at least one tamper evident band during opening; wherein said gripping structure is positioned substantially above said at least one tamper evident band so as to place stress on said at least one tamper evident band when lifted.

* * * * *